United States Patent [19]

Thiele

[11] 4,344,872

[45] Aug. 17, 1982

[54] METHOD AND APPARATUS FOR REMOVING WASTE PRODUCTS FROM SOLUTIONS OF FISSION PRODUCTS

[75] Inventor: Dietrich Thiele, Jülich-Stetternich, Fed. Rep. of Germany

[73] Assignee: Kernforschungsanlage Jülich Gesellschaft mit beschränkter Haftung, Fed. Rep. of Germany

[21] Appl. No.: 56,939

[22] Filed: Jul. 12, 1979

[30] Foreign Application Priority Data

Jul. 17, 1978 [DE] Fed. Rep. of Germany ..... 2831316

[51] Int. Cl.[3] ..... G21F 9/16; G21F 9/08

[52] U.S. Cl. ..... 252/629; 159/DIG. 12; 422/159; 252/630

[58] Field of Search ..... 252/301.1 W; 423/2; 422/159; 159/DIG. 12

[56] References Cited

U.S. PATENT DOCUMENTS

| | | | |
|---|---|---|---|
| 2,977,194 | 3/1961 | Loeding et al. | 423/2 |
| 3,120,493 | 2/1964 | Clark et al. | 252/301.1 W |
| 3,962,114 | 6/1976 | Berreth | 252/301.1 W |

FOREIGN PATENT DOCUMENTS

| | | | |
|---|---|---|---|
| 49-63653 | 6/1974 | Japan . | |
| 968763 | 9/1964 | United Kingdom | 159/DIG. 12 |

OTHER PUBLICATIONS

Dierks et al., "Wiped Film Evaporator for High Level Wastes", *Chem. Abstracts,* vol. 85 (1976), #112371h.

*Primary Examiner*—Deborah L. Kyle
*Attorney, Agent, or Firm*—Becker & Becker, Inc.

[57] ABSTRACT

A method and apparatus for removing waste products from solutions of fission products, especially nitric solutions, which contain ruthenium. The method utilizes concentration and solidification, especially vitrification, with the solution being concentrated to a solid content of at least about 15 to 20% in a vacuum at a pressure of at most about 50 mm Hg. The apparatus includes a vacuum evaporator, a subsequent mixing device which is fed by nitrate decomposing agents and vitrifiers, and a vitrifying oven. A drying device may be interposed between the mixing device and the oven. Preferably an ammonia derivative, especially urea, is added to the concentrate before solidification.

6 Claims, 1 Drawing Figure

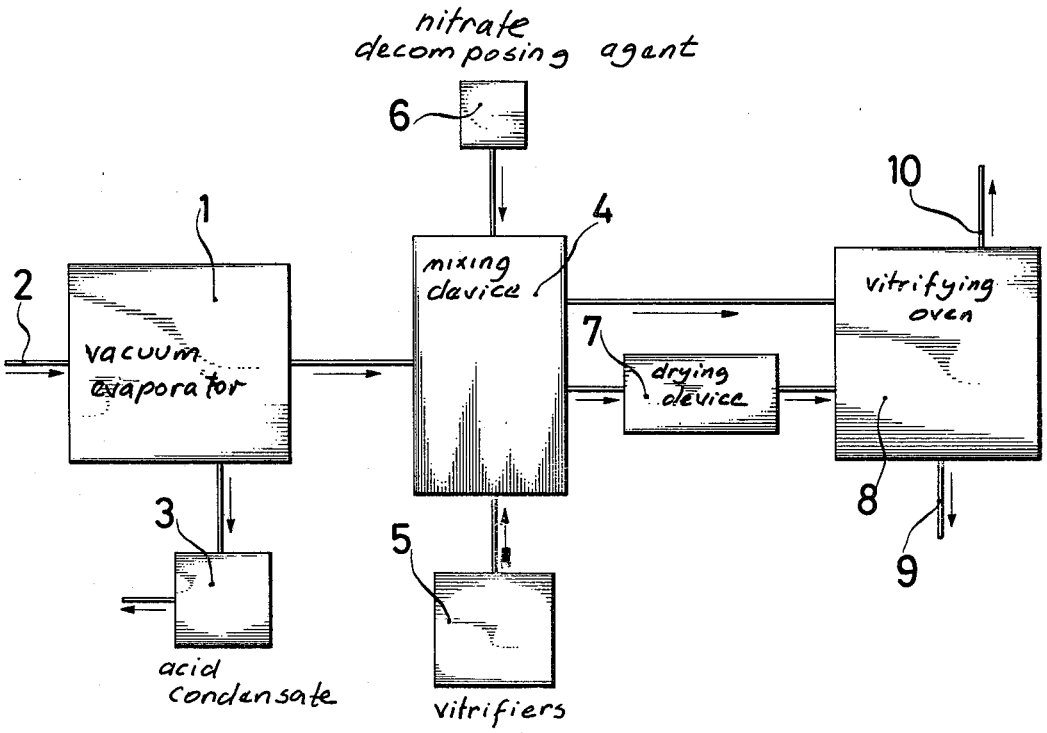
nitrate
decomposing agent
6
1
4
10
2
vacuum
evaporator
mixing
device
7
drying
device
vitrifying
oven
8
3
5
9
acid
condensate
vitrifiers

METHOD AND APPARATUS FOR REMOVING WASTE PRODUCTS FROM SOLUTIONS OF FISSION PRODUCTS

The present invention relates to a method of removing waste products proceeding on the basis of solutions of fission products, particularly nitric solutions, which contain ruthenium. This method utilizes concentration and solidification, particularly vitrification. The present invention also relates to an apparatus which is suitable for carrying out this method.

During the reworking of highly burned up nuclear fuel, a nitric aqueous phase with the entire fission products usually remains after the separation of uranium and thorium with organic extraction agents. In so doing, 7.3 $m^3$ solution having a residue on ignition of 1.6% and an acidity of 1.45 M/l nitric acid is obtained, for example, per metric ton of heavy metal.

These solutions, which due to their high radioactivity cannot be removed in a simple manner, are concentrated for a final storage, and the concentrate obtained is then preferably solidified by vitrification.

This operation though simple in principle is complicated by the presence of nitrate, and particularly nitric acid, since the oxidizing conditions caused by their presence, at high temperatures, lead to evaporation of ruthenium-106 in the form of ruthenium tetroxide. In addition, toxic waste gases result, which contain nitrous fumes ($NO_x$) and have a corrosive effect, causing additional problems. The ruthenium evaporation occurs particularly already during concentration of the solutions by distillation or similar methods of concentration. For this reason, the concentration and solidification are generally preceded by a denitration by adding reducing agents such as formic acid, formaldehyde, or sugar, according to which nitrous gases are liberated from the nitric acid and the easily decomposable nitrates. In subsequent condensers and washers, these nitrous gases can be reconverted into nitric acid. The very stable alkali and earth alkali nitrates decompose only at increased oven temperatures during the solidification or vitrification. The thereby acidic corrosive oven waste gases can therefore only be discharged into the atmosphere after costly washing.

In addition to this customary denitration, concentration and solidification or vitrification, a method of treating chiefly neutral or alkali solutions of fission products which contain nitrates and nitrites is known. According to this known method, the solution of fission products is mixed with a quantity of urea which is stoichiometric relative to the nitrite and nitrate content of the solution; the solution is heated up, particularly to temperatures of at least 130° C. to 180° C., until the water content is removed. Such a dehydrating denitration in a closed receptacle is not usable with nitric solutions of fission products, because these solutions tend to foam very strongly without a corresponding decomposition.

It is an object of the present invention to obtain a good separation of nitric acid from solutions of fission products without evaporation of ruthenium.

This object, and other objects and advantages of the present invention, will appear more clearly from the following specification in connection with the accompanying examples and drawing, which is a flow diagram of the apparatus used to carry out the method of the present invention.

The method of the present invention is characterized primarily in that the solution is concentrated to a solid content of at least about 15 to 20% in a vacuum at a pressure of at most about 50 mm Hg.

It was unexpectedly discovered that an extensive separation of the nitric acid without evaporation of ruthenium could be achieved if the fission product solution was concentrated in a vacuum at the corresponding pertaining low temperatures.

With such a vacuum concentration, less than 1 ppm ruthenium is present in the acid condensate, and the separated nitric acid can be recovered with relative ease.

The concentrate which is obtained from the vacuum concentration can be temporarily stored. A particularly favorable refinement of the method of removing waste products according to the present invention consists however in a combination of vacuum concentration and subsequent solidification, particularly vitrification, accompanied by the addition of ammonia derivatives, such as calcium cyanamide or especially urea, which react with nitrate along with the formation of reaction products, such as nitrogen, laughing gas (nitrous oxide), carbon monoxide, dioxide, etc, which comprise no nitrogen oxides rich in oxygen, so that the nitrous fumes content of the waste gas remains low. By such a vitrification of the concentrate along with the addition of vitrifiers and, as the case may be, intermediate drying, the occurrence of nitrous gases in the oven waste gas is avoided.

Pursuant to the present invention, a considerable simplification of the treatment of solutions of fission products, particularly nitric solutions, is obtained in that the normally customary denitration, concentration, drying, and fusion along with restraint of nitrous gases is replaced by the steps of vacuum concentration accompanied by simple recovery of nitric acid—followed, as the case may be, by drying—and fusing with ammonia derivatives, particularly addition of urea.

Referring now to the drawing in detail, the flow diagram depicts an apparatus for carrying out the inventive combined methods of vacuum concentration and vitrification accompanied by nitrous-free nitrate reduction, especially with the addition of urea.

A vacuum evaporator 1, especially a wiping blade evaporator, possibly a two-step evaporator, is charged at 2 with the solution of fission products, particularly a nitric solution. The solution is concentrated in the evaporator with recovery of acid condensate at 3, which condensate can be returned for fuel dissolving. The concentrate is mixed in the mixing device 4 with vitrifiers (added at 5) and a nitrate decomposing agent, particularly urea (added at 6), and passes either directly or after intermediate drying at 7 into the vitrifying oven 8. The vitrification of the mass along with simultaneous decomposition of nitrates takes place in the oven 8. The vitrified material leaves the oven at 9, while the practically nitrous-free waste gases are liberated at 10.

The method proceeds as follows:

(1) Vacuum Concentration

The separation of the nitric acid from the fission product solution is preferably effected in a wiping blade evaporator, System-Sambay, at about 20 mm Hg pressure (corresponding to 35° to 40° C. vapor temperature). During concentration to 1/10 of the starting volume, a good 40% of the total nitrate quantity is separated out as nitric acid. Preferably, the concentrate residue obtained is rediluted with water (approximately in the ratio of 1:1), and is again concentrated as before, resulting in an increase of the nitric acid separation to a good 70%. Ruthenium was detectable in the acid condensate only in quantities below 1 ppm (decontamination factor: $10^3$). Up to a solid content of 25%, the concentrate flows off freely and without forming a crust. The nitrate content is about 9 M/l, of which about ⅓ is difficult to decompose nitrate.

The preceding concentration can be utilized to reduce the volume of fresh solutions of fission products which are first to be temporarily stored. As a result, the space which is required and the corrosiveness are reduced. The degree of concentration depends upon the maximum allowable decay energy of the fission products per volume and the chemical characteristics of the solution. However, after the addition of urea and the corresponding vitrifiers, the concentrate can also be supplied directly to a subsequent solidification process, particularly a drying and vitrifying process. To adapt to reliable and practiced technologies, a drying by means of a roller or drum dryer can be provided. The addition of urea can take place prior to the drying or directly before the fusing. A fluid dosing of waste-vitrifier-urea-suspension into the smelting or vitrifying oven is also possible.

After being concentrated, the separated-off acid can be returned to the dissolving process.

(2) Vitrification, particularly with the addition of urea

The fission product concentrate obtained pursuant to step (1) is, in conformity with the respective formula, mixed with vitrifiers as well as with a quantity of urea which, according to the total nitrate content and the ratio of nitrate to free acid, is about 20 to 300% of the nitrate content. Determinative is the nitrous fumes content of the melting off gas, which should be below 3% by volume $NO_x$. The thus obtained mixtures can readily be dehydrated, for example, with a roller dryer, and yield a less powdery, more granular product, which can be easily and freely melted in a melting device to a clean glass mass.

EXAMPLE 12 l fission product solution (with about 1.5 M/l nitrate and 1.6% fission product oxide) with 17.9 Mol nitrate were concentrated in a wiping blade evaporator at 40 mm Hg pressure and a corresponding vapor temperature of 44° C. 1.083 l concentrate (with 9.35 M/l nitrate and 11.8% fission product oxide) as well as 10.4 l distillate (with an acid content of 0.7 M/l) was obtained. The degree of concentration (12 l:1.083 l) was about 11.

The nitrate balance is computed as follows:

From the starting amount of 17.9 Moles nitrate 10.1 Moles nitrate remained in the concentrate corresponding to a reduction of about 44%; 7.28 Moles nitrate are found in the distillate.

The concentrate was rediluted with water (1:1), and was again evaporated under the same conditions, yielding 520 ml concentrate (with 9.82 M/l nitrate and 24.6% fission product oxide) as well as 1460 ml distillate (with an acid content of 2.6 M/l) at a degree of concentration (altogether) of 23. The nitrate balance of this two-step treatment is as follows:

| Starting solution | Concentrate 2 | Distillate 1 and 2 |
|---|---|---|
| 17.9 M nitrate | 5.1 M nitrate | 7.28 + 3.80 M = 11.1 M nitrate |

i.e., a reduction of 71.5% of the starting nitrate quantity.

100 g fission product concentrate (with 9.36 M/l nitrate and 20% fission product oxide) was, with the addition of water, mixed with 38 g silicic acid ($SiO_2$), 30 g borax, 11 g boron oxide, and 15 g calcium oxide and, in the ratio nitrate:urea=3:1, was mixed with 15 g urea. The mixture was dried and continuously dosed into a melting crucible which was at 1100° C. The collected waste gas contained 3% by volume $NO_x$, 10% $CO_2$ and 10.8% CO, as well as unknown quantities of $N_2$ and $N_2O$ from the reaction between nitrate and urea and was nearly colorless. The fused glass was yellowish-gray, ceramic-like, and "homogeneous" (i.e. in itself uniform).

The advantages of the method of the present invention, which were in part already expanded upon above, comprise a reduction of the method steps, an extensive recovery of acid, a lower usage of reduction agents, and a simplification of the waste gas treatment.

The present invention is, of course, in no way restricted to the specific disclosure of the specification, examples, and drawing, but also encompasses any modifications within the scope of the appended claims.

What I claim is:

1. A method of removing fission products from ruthenium-containing nitric acid solutions and thereafter isolating the fission products in a solid mass, the method comprising in combination the steps of:

concentrating said solution by evaporation of the nitric acid therefrom to form a fission products concentrate having a solids content in the range of fifteen to twenty-five percent by exposing the solution to a partial vacuum having a pressure below fifty millimeters of mercury and by maintaining the temperature of the solution at a level sufficient to ensure evaporation of the nitric acid at that pressure whereby the evaporated nitric acid has a ruthenium content below one part per million;

condensing the nitric acid vapor having a ruthenium content below one part per million;

separating the nitric acid condensate from the fission products concentrate;

adding vitrifiers and ammonia derivatives capable of nitrous-free nitrate decomposition to the fission products concentrate to form a fission product-vitrifier mixture with a reduced nitrate content, and heating in an oven the fission product-vitrifier mixture to vitrify same and to thereby isolate the fission products in a solid mass.

2. A method according to claim 1, which includes the steps of diluting the fission products concentrate with water and repeating said vacuum concentration step prior to said adding step.

3. A method according to claim 1, which includes the step of carrying out said concentrating step in a wiping blade evaporator.

4. A method according to claim 1, in which said ammonia derivative is urea and is added in a quantity of about 20 to 300% Mol relative to the nitrate content of said concentrate fission products.

5. A method according to claim 1, which includes the step of drying fission product-vitrifier mixture prior to said heating step.

6. A method according to claim 1, which includes the step of purging the oven with an inert gas during said heating step.

* * * * *